United States Patent [19]

Ray et al.

[11] 4,410,490

[45] Oct. 18, 1983

[54] NICKEL AND COBALT ALLOYS WHICH CONTAIN TUNGSTEN AAND CARBON AND HAVE BEEN PROCESSED BY RAPID SOLIDIFICATION PROCESS AND METHOD

[75] Inventors: Ranjan Ray, Burlington; Viswanathan Panchanathan, North Billerica, both of Mass.

[73] Assignee: Marko Materials, Inc., No. Billerica, Mass.

[21] Appl. No.: 397,053

[22] Filed: Jul. 12, 1982

[51] Int. Cl.[3] ..... C22C 38/08; C22C 38/22

[52] U.S. Cl. ..... 420/454; 420/435; 420/436; 420/441; 420/442; 148/403

[58] Field of Search ..... 420/454, 442, 435, 436, 420/441; 148/403, 408, 409, 425, 426, 427

[56] References Cited

U.S. PATENT DOCUMENTS

| | | | |
|---|---|---|---|
| 4,056,411 | 11/1977 | Chen et al. | 420/435 |
| 4,067,732 | 1/1978 | Ray | 420/454 |
| 4,297,135 | 10/1981 | Giessen et al. | 148/425 |
| 4,359,352 | 11/1982 | Ray et al. | 148/410 |
| 4,365,994 | 12/1982 | Ray | 148/403 |

*Primary Examiner*—Andrew Metz
*Assistant Examiner*—S. Kastler

[57] ABSTRACT

New nickel and cobalt base alloys containing tungsten and carbon are disclosed. The alloys are subjected to rapid solidification processing (RSP) technique which produces cooling rates between $10^{5°}$ to $10^{7°}$ C./sec. The as-quenched ribbon, powder, etc. consists predominantly of amorphous phase. The amorphous phase is subjected to suitable heat treatments so as to produce a transformation to a microcrystalline alloy which includes carbides; this heat treated alloy exhibits high hardness combined with toughness for many applications wherein superhard materials are required.

11 Claims, No Drawings

NICKEL AND COBALT ALLOYS WHICH CONTAIN TUNGSTEN AAND CARBON AND HAVE BEEN PROCESSED BY RAPID SOLIDIFICATION PROCESS AND METHOD

BACKGROUND OF THE INVENTION

This invention relates to rapidly solidified nickel and cobalt base alloys which contain tungsten and certain critical amounts of carbon. This invention also relates to the preparation of these materials in the form of rapidly solidified powder and consolidation of these powders into bulk parts which are optionally heat treated to have very high hardness combined with toughness.

DESCRIPTION OF THE PRIOR ART

Cemented carbides find extensive applications as superhard materials (i.e.) materials which are much harder than any tool steel. They find applications in metal working tools, mining tools, and wear resistant parts. Cemented carbides are made by powder metallurgy process in which finely divided compounds of refractory metals and carbon are bonded together to form a compacted solid of high strength and hardness. The main binder material used is cobalt. In recent years many modifications have been made to produce complex grades containing WC,TiC,TaC,$Cr_3C_2$, etc. (see Metals Hand Book, Vol. 3, 9th edition, p. 448).

Cemented carbides are generally brittle and hence are not suitable for cutting and forming tool applications where the parts are subjected to shock under service conditions. Cemented tungsten carbides combine high hot hardness and high density. Yet, low impact strength characteristics of these materials have limited their widespread application as armor projectiles. Efforts to improve mechanical properties, specially toughness in cemented carbides are continuing by use of (a) carbides having extremely fine and uniform size, (b) ductile binder material e.g. nickel, (c) new compositions.

Design of alloys made by conventional processes is largely influenced by the corresponding equilibrium phase diagrams, which indicate the existence and coexistence of the phases present in thermodynamic equilibrium. Alloys prepared by such processes are in, or at least near, equilibrium. The advent of rapid quenching from the melt has enabled material scientists to stray further from the state of equilibrium and has greatly widened the range of new alloys with unique structure and properties available for technological applications.

Rapid solidification processing techniques offer outstanding prospects for the creation of new breeds of cost effective engineering materials with superior properties. (See Proceedings, Second Int. Conf. on Rapid Solidification Processing, Reston, Va., March 1980, published by Claitor's Publishing Division, Baton Rouge, La., 1980). Metallic glasses, microcrystalline alloys, highly supersaturated solid solutions and ultrafine grained alloys with highly refined microstructures, in each case often having complete chemical homogeneity, are some of the products that can be made utilizing rapid solidification processing (RSP). (See Rapidly Quenched Metals, 3rd Int. Conf., Vol 1 & 2, B. Cantor, Ed., The Metals Society, London, 1978).

Several techniques are well established in the state of the art to economically fabricate rapidly solidified alloys (at cooling rate of $10^5$ to $10^7$° C./second) as ribbons, filaments, wire, flakes or powders in large quantities. One well-known example is melt-spin chill casting, whereby the melt is spread as a thin layer on a conductive metallic substrate moving at high speed (see Proc. Int. Conf. on Rapid Solidification Processing, Reston, Va., November 1977, p. 246) whereby a rapidly solidified thin ribbon is formed.

Efforts to develop new compositions which are fabricated via rapid solidification processing having appropriate microstructures leading to superior mechanical properties desirable for practical applications are continuing. In particular, rapid solidification can be used to produce metastable extended solid solutions wherein a large excess of a solute element can be retained uniformly throughout the host element or alloy. Upon suitable heat treatment, a fine dispersion of particles of the equilibrium intermetallic phase within the host matrix can be produced. The potential for using this approach to produce unusual dispersion-hardened alloys based on iron, nickel, and aluminum has been recognized. However, there has been no disclosure in the prior art about synthesizing superhard alloys containing large amounts of dispersed refractory carbide phases in a ductile nickel or cobalt base matrix whereby such a dispersion is achieved via decomposition of a prealloyed phase.

SUMMARY OF THE INVENTION

This invention features a class of nickel/cobalt base alloys having high hardness and toughness when the production of these alloys includes a rapid solidification process. The said alloys which are prepared by a rapid solidification process have compositions described by the following general formula:

$$(Ni,Co)_aW_b(Cr,Fe)_cB_dC_e \quad (A)$$

wherein Ni,Co,W,Cr,Fe,B, and C are respectively nickel, cobalt, tungsten, chromium, iron, boron, and carbon; b,d, and e represent atom percent of W,B, and C respectively, a represents atom percent of one or more of Ni and Co, and c represents atom percent of one or more of Fe and Cr and have the following values:

a=50–70
b=15–35
c=0–10
d=1–4 and
e=5–25;

wherein a+b+c+d+e=100. All subscripts are in atom percent, unless otherwise specified.

Rapid solidification processing (RSP) (i.e. processing in which the liquid alloy is subjected to cooling rates of the order of $10^5$ and $10^7$° C./second) of such alloys produces predominantly a metallic glass (i.e. amorphous) structure which is chemically homogeneous and can be heat treated and/or thermomechanically processed so as to form crystalline alloy with ultrafine grain structure. The alloy is prepared as rapidly solidified ribbon by melt-spinning techniques. The as quenched ribbon is brittle and is readily comminuted to a staple or powder using standard pulverization techniques e.g. a rotating hammer mill. The powder is consolidated into bulk shapes using conventional hot consolidation methods, for example, hot isostatic pressing or cold pressing and sintering. The consolidated alloy is optionally heat treated to obtain optimum microstructures. The final transformed product is tough with good mechanical properties.

DETAILED DESCRIPTION OF THE INVENTION

In accordance with the present invention nickel and cobalt base alloys containing 15–35 atom percent of tungsten are alloyed with 0–10 atom percent of one or more of chromium and iron, 1–4 atom percent of boron and 5–25 atom percent of carbon. The alloys may also contain limited amounts of other elements which are commercially found in nickel and cobalt base alloys without changing the essential behavior of the alloys. Typical examples include: $Ni_{32}Co_{30}W_{25}C_{10}B_3$, $Ni_{32}Co_{25}W_{30}C_{10}B_3$, $Co_{29}Ni_{30}W_{25}C_{13}B_3$, $Ni_{50}W_{30}B_1C_{19}$, $Co_{50}W_{35}B_1C_{14}$, $Ni_{58}W_{20}B_2C_{20}$, $Co_{60}W_{18}C_{20}B_2$, $Ni_{33}Co_{25}W_{20}Cr_5Fe_2C_{12}B_3$, $Ni_{35}Co_{35}W_{15}Cr_5B_2C_8$, and $Co_{55}Ni_{15}W_{15}Cr_5B_2C_8$.

The alloys of the present invention upon rapid solidification processing the melt by melt-spin chill casting at cooling rates of the order of $10^5$ to $10^7$° C./second form brittle ribbons consisting predominantly of metallic glass (i.e. amorphous) phase with a high degree of compositional uniformity and high hardness 1200–1900 Kg/mm$^2$). The brittle ribbons are readily pulverized into powders having particle size less than 4 U.S. mesh using standard comminution techniques. The powder is consolidated into bulk parts using powder metallurgical techniques, e.g. hot isostatic pressing, optionally followed by heat treatments for optimum properties.

The above powder has preferred particle size less than 60 mesh (U.S. Standard) comprising platelets having an average thickness of less than 0.1 mm and each platelet being characterized by an irregularly shaped outline resulting from fracture thereof.

The bulk alloys are crystalline, such material being tough and having high hardness and strength compared to conventional alloys.

The melt-spinning method referred to herein includes any of the processes such as single roll chill block casting, double roll quenching, melt extraction, melt drag, etc., where a thin layer or stratum of metal is brought in contact with a solid substrate moving at a high speed.

When the alloys within the scope of the present invention are solidified by conventional slow cooling processes they inherit highly segregated microstructures with compositional nonuniformity and hence exhibit poor mechanical properties, and are very brittle. In contrast, when the alloys are made using RSP techniques followed by heat treatment at high temperatures, preferably between 1000°–1300° C. for 0.5 to 20 hours, crystallization of the rapidly solidified glassy phase takes place forming an aggregate of ultrafine crystalline (microcrystalline) phases.

The microcrystalline alloy devitrified from glassy state has matrix grain size of less than about 5 microns, preferably less than 1 micron randomly interspersed with particles of complex carbides said particles having an average particle size measured in its largest dimension of less than about 0.5 micron, preferably less than 0.2 micron and said carbide particles being predominantly located at the junctions of at least three grains of fine grained solid solution phase.

The fully heat treated RSP alloys of the present invention exhibit high hardness and toughness. High hardness of the present alloys is due to ultrafine grain structure which is additionally stabilized and dispersion hardened by ultrafine hard tungsten carbides. As a consequence of rapid solidification processing, it is possible to produce a homogeneous predominantly glassy alloy with large amounts of interstitial elements. Upon devitrification (i.e. crystallization) of the glassy phase, a homogeneous aggregate of microcrystalline phases form. Conventional nickel and cobalt base alloys containing tungsten between 15–35 at pct. which are processed by standard slow casting method usually have hardness values ranging between 700 to 900 Kg/mm$^2$. In comparison, the alloys of the present invention possess significantly higher hardness values i.e. between 850 to 1400 Kg/mm$^2$. Such high hardness values combined with uniform microstructures will render them especially suitable for applications as hard, wear resistant materials, e.g. cutting tools, wear strips, metal forming components, mining components, etc. A small amount of boron additions to the present alloys has been found to be desirable, since boron has been found to enhance the ribbon fabricability of the alloys by the method of melt-spinning. The preferred boron content is less than 4 atom percent. When boron content is greater than 4 atom percent, the microcrystalline alloy devitrified from the glassy state contains excessive amounts of borides which tend to render the alloys less tough.

The carbon content of the present alloys is critical. Besides its significance in improving the hardness at high temperature, it also enhances ribbon fabricability of the alloys by the method of melt-spinning. When the carbon content is less than 5 atom percent the alloys are difficult to form as rapidly solidified ribbons by the method of melt deposition on a rotating chill substrate i.e. melt-spinning. This is due to the inability of the alloy melts with low carbon contents to form a stable molten pool on the quench surface. Such alloys do not readily spread into a thin layer on a rotating substrate as required for melt-spinning.

When the carbon content is greater than 25 atom percent excessive amounts of carbides are formed. The heat treated alloys are very brittle due to excessive amounts of brittle carbide phases exhibiting poor mechanical properties.

Of particular interest in these alloys are increased hardness combined with good toughness compared to conventional materials.

The alloys of the system Ni-W-C-B with contents 15–20 atom percent prepared in accordance with the present invention belong to a preferred group of alloys. The alloys are described by the general formula:

$$Ni_{57\text{-}69}W_{15\text{-}20}C_{15\text{-}20}B_{1\text{-}3}$$

Another preferred class of alloys is based on the system Co-W-C-B. These are described by the general formula:

$$Co_{57\text{-}69}W_{15\text{-}20}C_{15\text{-}20}B_{1\text{-}3}.$$

Cemented carbides find extensive applications as superhard materials. They essentially consist of tungsten carbide with a binder, usually cobalt. Over the years this has been modified in many ways to produce a variety of cemented carbides. They consist of mainly varying the binder content, grain size of the carbide and substituting other metallic carbides for part of the tungsten carbide. For straight tungsten carbide grades, increasing cobalt content increases transverse strength and toughness but decreases hardness. For example, 97WC-3Co has a hardness of about 1750 Kg/mm$^2$, whereas 75Wc-25Co has hardness of only 800 Kg/mm$^2$. However, alloys containing high amounts of cobalt which when processed by RSP, show significantly high hardness (~1200–1500) combined with good toughness. This is due to the fine grained structure of the microcrystalline alloy devitrified from homogeneous metallic phase.

Similarly nickel-base alloys containing refractory carbides can fine extensive applications as penetrators. Fairly high density of these materials (13–14 g/cm$^3$) combined with high hardness and toughness with very fine grain structure makes them suitable for potential application as penetrator materials.

Thus a wide range of useful materials, such as wire drawing dies, cutting tools, metal framing and mining components, armor projectiles, etc., can be manufactured by suitable composition selection from the invention of the present alloys.

EXAMPLES 1 to 11

Alloys of composition in Table 1 were melt-spun into brittle ribbons having thicknesses of 25 to 75 microns by the RSP technique of melt-spinning using a rotating Cu-Be cylinder having a quency surface speed of ~5000 ft/min. The ribbons were found by X-ray diffraction analysis to consist predominantly of a metallic glass phase. Ductility of the ribbons was measured by the bend test. The ribbon was bent to form a loop and the diameter of the loop was gradually reduced until the loop was fractured. The breaking diameter of the loop is a measure of ductility. The larger the breaking diameter for a given ribbon thickness, the more brittle the ribbon is considered to be i.e. the less ductile. The ribbons show improved bend ductility upon heat treatment at high temperatures, as indicated by lower breaking diameters. Table 1 gives the breaking diameters and hardness values of a number of rapidly solidified alloys of the present invention before and after heat treatment.

TABLE 1

| Example | Alloy Composition (atom percent) | As Quenched Ribbon Hardness (Kg/mm$^2$) | As Quenched Ribbon Breaking Dia. (inch) | Ribbon Heat Treated (1150° C. for 2 hrs) Hardness Kg/mm$^2$ | Ribbon Heat Treated (1150° C. for 2 hrs) Breaking Dia. (inch) |
|---|---|---|---|---|---|
| 1 | $Ni_{32}Co_{30}W_{25}C_{10}B_3$ | 1159 | 0.107 | 850 | 0.04 |
| 2 | $Ni_{32}Co_{25}W_{30}C_{10}B_3$ | 1250 | 0.127 | 870 | 0.042 |
| 3 | $Ni_{29}Co_{30}W_{25}C_{13}B_3$ | 1210 | 0.117 | 860 | 0.040 |
| 4 | $Ni_{25}Co_{40}W_{25}C_9B_1$ | 1127 | 0.103 | 840 | 0.035 |
| 5 | $Ni_{35}Co_{25}W_{15}C_{21}B_4$ | 1275 | 0.131 | 880 | 0.047 |
| 6 | $Ni_{32}Co_{25}Cr_3Fe_3W_{15}C_{18}B_4$ | 1180 | 0.125 | 840 | 0.037 |
| 7 | $Co_{47}Ni_3Fe_5W_{32}C_{10}B_3$ | 1357 | 0.141 | 900 | 0.043 |
| 8 | $Ni_{59}W_{20}C_{20}B_1$ | 1620 | 0.172 | 1300 | 0.075 |
| 9 | $Co_{59}W_{20}C_{20}B_1$ | 1875 | 0.189 | 1400 | 0.093 |
| 10 | $Ni_{50}W_{25}C_{24}B_1$ | 1609 | 0.177 | 1325 | 0.089 |
| 11 | $Co_{61}W_{18}C_{18}B_3$ | 1575 | 0.162 | 1272 | 0.083 |

EXAMPLES 12 to 20

50 to 60 gms of selected alloys as given in Table 2 were melt-spun as brittle ribbons having thicknesses of 25 to 75 microns by RSP method of melt-spinning using a Cu-Be cylinder having a quench surface speed of ~5000 ft/min. The ribbons were found by X-ray diffraction analysis to consist predominantly of amorphous phase. The brittle ribbons were pulverized into powder under 230 mesh or staple using a rotating hammer mill.

TABLE 2

| Example | Alloy Composition (atom percent) |
|---|---|
| 12 | $Co_{40}Ni_{25}W_{15}C_{18}B_2$ |

TABLE 2-continued

| Example | Alloy Composition (atom percent) |
|---|---|
| 13 | $Co_{32}Ni_{22}W_{28}C_{14}B_4$ |
| 14 | $Co_{32}Ni_{20}Fe_3Cr_5W_{25}C_{12}B_3$ |
| 15 | $Ni_{40}Co_{20}Fe_5Cr_5W_{15}C_{11}B_4$ |
| 16 | $Ni_{25}Co_{26}Fe_5Cr_5W_{30}C_6B_3$ |
| 17 | $Ni_{55}W_{20}C_{23}B_2$ |
| 18 | $Co_{55}W_{20}C_{23}B_2$ |
| 19 | $Co_{65}W_{19}C_{15}B_1$ |
| 20 | $Ni_{69}W_{15}C_{15}B_1$ |

EXAMPLE 21

The following example illustrates an economical method of continuous production of RSP powder of the nickel and cobalt base alloys of the composition indicated by the formula (A) of the present invention.

The nickel and cobalt base alloys are melted in any of the standard melting furnaces. The melt is transferred via a ladle into a tundish having a series of orifices. A multiple number of jets are allowed to impinge on a rotating water cooled copper-beryllium drum whereby the melt is rapidly solidified as ribbons. The as-cast brittle ribbons are directly fed into a hammer mill of appropriate capacity wherein the ribbons are ground into powders of desirable size ranges.

We claim:

1. A metallic alloy in powder form having predominantly an amorphous structure with particle size below 4 mesh (U.S. Standard) and composition described by the formula:

$$(Ni,Co)_aW_b(Cr,Fe)_cB_dC_e$$

wherein Ni,Co,W,Cr,Fe,B, and C are respectively nickel, cobalt. tungsten, chromium, iron, boron, and carbon; b,d, and e respectively represent atom percent of W,B, and C; a represents atom percent of one or more Ni and Co; and c represents atom percent of one or more of Cr and Fe, (wherein a=50–70, b=15–35, c=0–10, d=1–4, and e=5–25) with the provisos that a+b+c+d+e must be 100, wherein the said alloy is prepared by the method comprising the following steps:

(a) forming a melt of said alloy (b) depositing said melt against a rapidly moving quench surface adapted to quench said melt at a rate in the range of approximately $10^5$ to $10^7$° C./second and form thereby a rapidly solidified brittle stratum of said alloys characterized by predominantly an amorphous structure, and hardness values between 1200 and 1900 Kg/mm$^2$, and (c) comminuting said stratum into powders.

2. The alloys of claim 1 in powder form having an amorphous structure wherein said powders have average particle size of less than 60 mesh (U.S. Standard) comprising platelets having an average thickness of less than 0.1 mm and each platelet being characterized by an irregularly shaped outline resulting from fracture thereof.

3. The alloy of claim 1 in powder form with amorphous structure, wherein said powders have particle size below 230 mesh (U.S. Standard).

4. A metallic alloy having hardness values from 850–1400 $Kg/mm^2$ and having composition as given in claim 1 and microstructure consisting of ultrafine metallic carbides dispersed uniformly in an ultrafine grained nickel and cobalt rich matrix prepared in fully dense bulk shapes from amorphous powders fabricated according to claim 1, wherein said powders are subjected to heat and pressure in the temperature range, 1000°–1300° C.

5. The alloy of claim 4 in the form of a body having a thickness of at least 0.1 mm measured in the shortest dimension.

6. The alloy of claim 4 wherein said ultrafine grains have an average large dimension of less than 5 microns and said metallic carbides have an average particle size measured in its largest dimension of less than 0.5 micron.

7. The alloy of claim 4 wherein said ultrafine grains have an average large dimension of less than 2 microns and said metallic carbides have an average particle size measured in its largest dimension of less than 0.2 micron.

8. Carbon containing nickel/cobalt base alloys having the general formula:

$$(Ni,Co)_aW_b(Cr,Fe)_cB_dC_e$$

wherein Ni,Co,W,Cr,Fe,B, and Si are nickel, cobalt, tungsten, chromium, iron, boron and carbon respectively; b,d, and e respectively represent atom percent of W,B, and C; a represents atom percent of one or more of Ni and Co; and c represents atom percent of one or more of Cr and Fe, wherein a=50–70, b=15–35, c=0–10, d=1–4, and e=5–25 with the provisos that a+b+c+d+e must be 100, wherein the said alloys being composed of ultrafine grains of a primary nickel and cobalt rich phase randomly interspersed with ultrafine metallic carbides, wherein said ultrafine grains of the primary phase have an average dimension measured in its largest dimension of less than about 5 microns and wherein said grams have an average particle size measured in its largest dimension of less than about 0.5 micron.

9. The method of making an alloy according to claim 1 comprising the steps of (a) forming a melt of said alloy, (b) depositing said melt on a rapidly moving quench surface adapted to quench said melt at a rate in the range of approximately $10^5$ to $10^7$° C./sec and form thereby a rapidly solidified stratum of said alloy characterized by a predominantly amorphous structure and (c) comminuting said brittle stratum into powder.

10. The method of claim 9 wherein the quench rate is at least $10^6$° C./sec.

11. The method of claim 9 including the step of hot consolidating the said amorphous powders into bulk parts by application of heat and pressure in the temperature range of 1000° to 1300° C. for a time sufficient to cause consolidation of powders and transformation of the amorphous phase to a fine grained microstructure with primary grains having an average grain size of less than about 5 microns with a substantially uniform dispersion of ultrafine particles of carbides in the fine primary metallic grains, said ultrafine particles having a characteristic particle size of less than 0.5 micron.

* * * * *